US008167404B2

(12) United States Patent
Mantell et al.

(10) Patent No.: US 8,167,404 B2
(45) Date of Patent: May 1, 2012

(54) STAGGERED HEAD STITCH SHIFTS IN A CONTINUOUS FEED DIRECT MARKING PRINTER

(75) Inventors: David A. Mantell, Rochester, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 308 days.

(21) Appl. No.: 12/504,857

(22) Filed: Jul. 17, 2009

(65) Prior Publication Data

US 2011/0012958 A1 Jan. 20, 2011

(51) Int. Cl.
*B41J 2/15* (2006.01)
*B41J 2/145* (2006.01)

(52) U.S. Cl. ..... 347/41; 347/40; 347/42

(58) Field of Classification Search ..... 347/9, 12, 347/14, 15, 19, 40–43
See application file for complete search history.

(56) References Cited

U.S. PATENT DOCUMENTS

| | | | | |
|---|---|---|---|---|
| 4,940,996 | A * | 7/1990 | Paton et al. | 347/42 |
| 5,093,674 | A | 3/1992 | Storlie | |
| 5,500,667 | A | 3/1996 | Schwiebert et al. | |
| 5,633,668 | A | 5/1997 | Schwiebert et al. | |
| 6,017,113 | A | 1/2000 | Nicoloff, Jr. et al. | |
| 6,412,907 | B1 | 7/2002 | Castelli et al. | |
| 6,536,894 | B1 | 3/2003 | Rasmussen et al. | |
| 6,587,652 | B2 | 7/2003 | Metzler | |
| 6,788,432 | B1 | 9/2004 | Garcia et al. | |
| 6,799,830 | B1 | 10/2004 | Brookfield et al. | |
| 7,167,770 | B1 | 1/2007 | Akira | |
| 7,691,280 | B2 | 4/2010 | Waldrop et al. | |
| 2003/0132979 | A1 | 7/2003 | Taylor | |
| 2003/0156148 | A1 | 8/2003 | King et al. | |
| 2008/0124158 | A1 | 5/2008 | Folkins | |
| 2009/0141110 | A1 | 6/2009 | Gervasi et al. | |
| 2009/0293750 | A1 | 12/2009 | Haenni et al. | |
| 2010/0013882 | A1 | 1/2010 | Mizes et al. | |
| 2011/0012958 | A1 | 1/2011 | Mantell et al. | |

FOREIGN PATENT DOCUMENTS

EP 0340960 11/1989

(Continued)

OTHER PUBLICATIONS

European Search Report corresponding to European Patent Application 10169752.2, European Patent Office, Rijswijk, Netherlands, Oct. 26, 2010 (6 pages).

(Continued)

*Primary Examiner* — Thinh Nguyen
(74) *Attorney, Agent, or Firm* — Maginot, Moore & Beck, LLP

(57) ABSTRACT

An imaging device includes an image receiving surface configured to move in a process direction in the imaging device. A plurality of printhead arrays are arranged to deposit marking material onto the image receiving surface. Each printhead array includes a plurality of printheads arrayed in a cross-process direction across the image receiving surface. Each printhead array includes at least one stitch line corresponding to a position along an axis parallel to the cross-process direction where an end of one printhead in the printhead array aligns with an end of another printhead in the printhead array. The at least one stitch line of each printhead array is offset a predetermined distance in the cross-process direction from the at least one stitch line of each of the other printhead arrays.

20 Claims, 3 Drawing Sheets

FOREIGN PATENT DOCUMENTS

| | | | |
|---|---|---|---|
| EP | 1447226 | A1 | 8/2004 |
| EP | 1609602 | A3 | 12/2005 |
| EP | 1669204 | A1 | 6/2006 |
| WO | 0156798 | | 8/2001 |

OTHER PUBLICATIONS

United Kingdom Search Report corresponding to UK Application No. 1107830.0, United Kingdom Intellectual Property Office, Newport, South Wales, UK, Sep. 7, 2011 (3 pages).

* cited by examiner

STAGGERED HEAD STITCH SHIFTS IN A CONTINUOUS FEED DIRECT MARKING PRINTER

TECHNICAL FIELD

This disclosure relates generally to imaging devices having multiple printhead arrays, and more particularly, to the arrangement of the multiple printhead arrays in such imaging devices.

BACKGROUND

Some ink printing devices use a single printhead, but many use a plurality of printheads to increase the rate of printing. For example, some devices utilize a plurality of printhead arrays in which each array has multiple printheads arranged end to end across an image receiving surface. The ends of the printheads of an array are aligned at locations referred to as stitch lines or stitch joints. Differences in printing characteristics of the printheads on either side of a stitch line, such as drop mass, position or some other attribute, may result in visible stitch line defects between printheads. Stitch line defects may exhibit as either a specific line defect at the stitch joint or as a density shift between printheads. In either case, stitch line defects may result in an image quality defect known as banding that extends in the process direction on a printed media. Methods have been developed for compensating or masking stitch line defects between printheads of a printhead array. In previously known printhead systems that utilize multiple printhead arrays to form images on an image receiving surface, the stitch lines of the multiple printheads were aligned. Aligning the stitch lines of multiple printhead arrays may cause stitch line defects from different printhead arrays to coincide and become even more visible.

SUMMARY

The present disclosure proposes an arrangement of printhead arrays in a multiple printhead array system that prevents or limits cumulative stitch line defects from occurring. In particular, in one embodiment, an imaging device includes an image receiving surface configured to move in a process direction in the imaging device. A plurality of printhead arrays are arranged to deposit marking material onto the image receiving surface. Each printhead array includes a plurality of printheads arrayed in a cross-process direction across the image receiving surface. Each printhead array includes at least one stitch line corresponding to a position along an axis parallel to the cross-process direction where an end of one printhead in the printhead array aligns with an end of another printhead in the printhead array. The at least one stitch line of each printhead array is offset a predetermined distance in the cross-process direction from the at least one stitch line of each of the other printhead arrays.

In another embodiment, a method of arranging printhead arrays in an imaging device is provided. The method includes the arrangement of a first printhead array adjacent an image receiving surface at a first location in a process direction of the image receiving surface. The first printhead array includes at least one first stitch line corresponding to locations in the first printhead array where an end of one printhead in the first printhead array is aligned with an end of a next printhead in the first printhead array. The at least one first stitch line is located at a first position in the cross-process direction. A second printhead array is arranged adjacent the image receiving surface at a second location in the process direction of the image receiving surface. The second printhead array includes at least one second stitch line corresponding to locations in the second printhead array where an end of one printhead in the second printhead array is aligned with an end of a next printhead in the second printhead array. The at least one second stitch line is located at a second position in the cross-process direction different than the first position.

DETAILED DESCRIPTION

Figure 1:
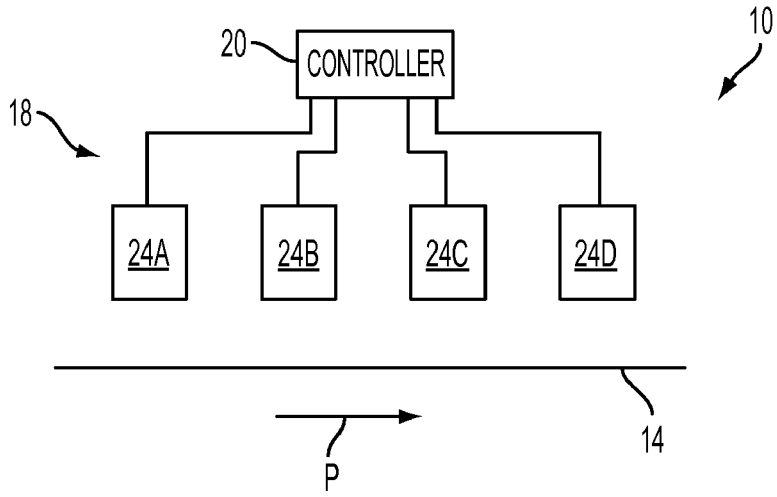
FIG. 1 is a simplified elevational view of an embodiment of an imaging device.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Recording media" can be a physical sheet of paper, plastic, or other suitable physical print media substrate for images, whether precut or web fed. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which the substrate onto which the image is transferred moves through the imaging device. The cross-process direction, along the same plane as the substrate, is substantially perpendicular to the process direction.

FIG. 1 is a simplified block diagram of one embodiment of an imaging device 10. As depicted in FIG. 1, the imaging device 10 includes an image receiving surface 14 that is transported in a process direction P in front of a printhead system 18 which deposit marking material onto the image receiving surface to form images. In one embodiment, the imaging device is a direct marking imaging device in which the image receiving surface comprises a very long (i.e., substantially continuous) web W of "substrate" (paper, plastic, or other printable material) upon which the images are directly formed by the printhead system. Alternatively, the imaging device may be an indirect marking device in which the image receiving surface comprises an intermediate transfer surface, in the form of a belt or drum, upon which images may be formed and subsequently transferred to a final receiving substrate such as a web or sheet of media. The image receiving surface may be linear or curved, may have any suitable path including horizontal, vertical, or combinations of horizontal and vertical, and may be transported in the process direction by the printhead system in any suitable manner. In addition, the imaging device may utilize a single pass or multi-pass printing process. In a single pass printing process, an image is formed on the image receiving surface in a single passage of the image receiving surface past the printhead system. In a multi-pass printing process, an image is built up on the image receiving surface in multiple passages of the image receiving surface past the printhead system. For example, the image receiving surface of FIG. 1 may comprise a belt or drum that is configured for rotation in front of the printhead system.

The printhead system 18 includes a series of printhead arrays 24A-D, each printhead array including a plurality of printheads arrayed across the width of the image receiving surface in a cross-process direction, i.e., substantially perpendicular to the process direction (explained in more detail below). Each printhead includes a plurality of ink jets for emitting ink onto the web. The printheads of a printhead array may each be completely separate units mounted on a single fixed bar or positioning device. Alternatively, printheads of a printhead array may comprise groupings of similarly utilized and/or manufactured ink jet ejectors, e.g., silicon dies placed on a flat backer bar.

For simplicity, four printhead arrays are shown in FIG. 1, each printhead array being configured to deposit ink of one color onto the image receiving surface although any suitable number of printhead arrays may be utilized. As explained below, multiple printhead arrays may be provided for each color or shade of ink used in the imaging device. As is generally familiar, images of different colors formed by the different printhead arrays are placed on overlapping areas on the image receiving surface to form multi-color images, based on the image data sent to each printhead array through image path 22 from print controller 20.

In one embodiment, the ink utilized in the imaging device 10 is a "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 100° C. to 140° C. In alternative embodiments, however, any suitable marking material or ink may be used including, for example, toner, aqueous ink, oil-based ink, UV curable ink, or the like.

Figure 2:
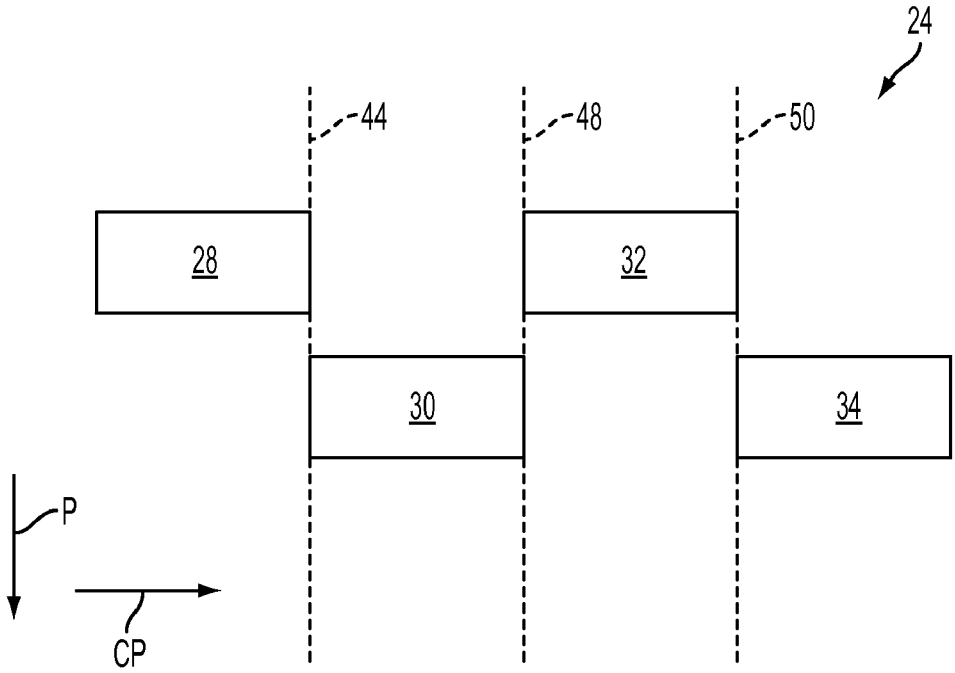
FIG. 2 is a simplified elevational view of a printhead array of the imaging device of FIG. 1.

Referring now to FIG. 2, an embodiment of a printhead array is depicted. A printhead array includes a plurality of printheads that are arrayed substantially end-to-end in a cross-process direction CP across the width of the image receiving surface 14 (not shown in FIG. 2). In the embodiment of FIG. 2, each printhead array 24 includes four printheads although the printhead arrays may have more or fewer printheads. Each printhead 32, 34, 36 and 38 of a printhead array has a corresponding front face through which marking material, such as melted phase change ink, may be emitted onto the receiving surface 14 to form images.

In the embodiment of FIG. 2, the printhead array 24 comprises a staggered full width array (SFWA). An SFWA includes four printheads 28, 30, 32, 34 arranged in two rows with each row having two printheads. Each row of printheads in the SFWA is located at a different position along the process direction P of the image receiving surface path. As depicted, the two printheads 28, 32 in the first row are separated in the direction CP by a distance corresponding to the width of a printhead. The first printhead 30 in the second row is positioned at a location corresponding to the gap between the two printheads 28, 32 in the first row and the last printhead 34 in the second row is separated from the first printhead 30 in the second row by a distance corresponding to the width of a printhead.

The ends of the printheads of the SFWA are aligned at stitch lines 44, 48, 50. As used herein, the term stitch line refers to the location in the array where an end of one printhead in the array aligns with or slightly overlaps the end of the next adjacent printhead in the array in the cross-process direction. For example, in FIG. 2, the end of printhead 28 and an end of printhead 30 each abut or are aligned on stitch line 50. The other end of printhead 30 and one end of printhead 32 are aligned on stitch line 48. The other end of printhead 32 and the end of printhead 34 are each aligned on stitch line 50. As seen in FIG. 2, stitch lines 44, 48, 50 are generally parallel to the process direction P of the image receiving surface. Although the embodiment of the printhead array in FIG. 2 is a SFWA, other printhead array arrangements are contemplated within the scope of this disclosure. For example, the printheads of a printhead array may be arranged linearly end-to-end in the cross-process direction or the printheads of a printhead array may also be staggered in more than the two rows depicted in FIG. 2.

As mentioned above, the printheads of a printhead array may be slightly overlapped at the stitch lines so that the stitch lines correspond to an overlap zone between the printheads of a printhead array where the last few jets of each printhead are interlaced. For example, the adjacent ends of printheads in a printhead array may be overlapped by a number of pixels and alternate jets are printed in the overlap region. One example would be to overlap the last two jets of each head. Stitching the printheads of an array may also include using the last jet of each head but not the next to last jet. This would spread the stitch line over two pixels. Greater overlaps could be used by alternating every other jet in the overlap region or alternating greater multiples of jets such as pairs of jets.

Figure 4:
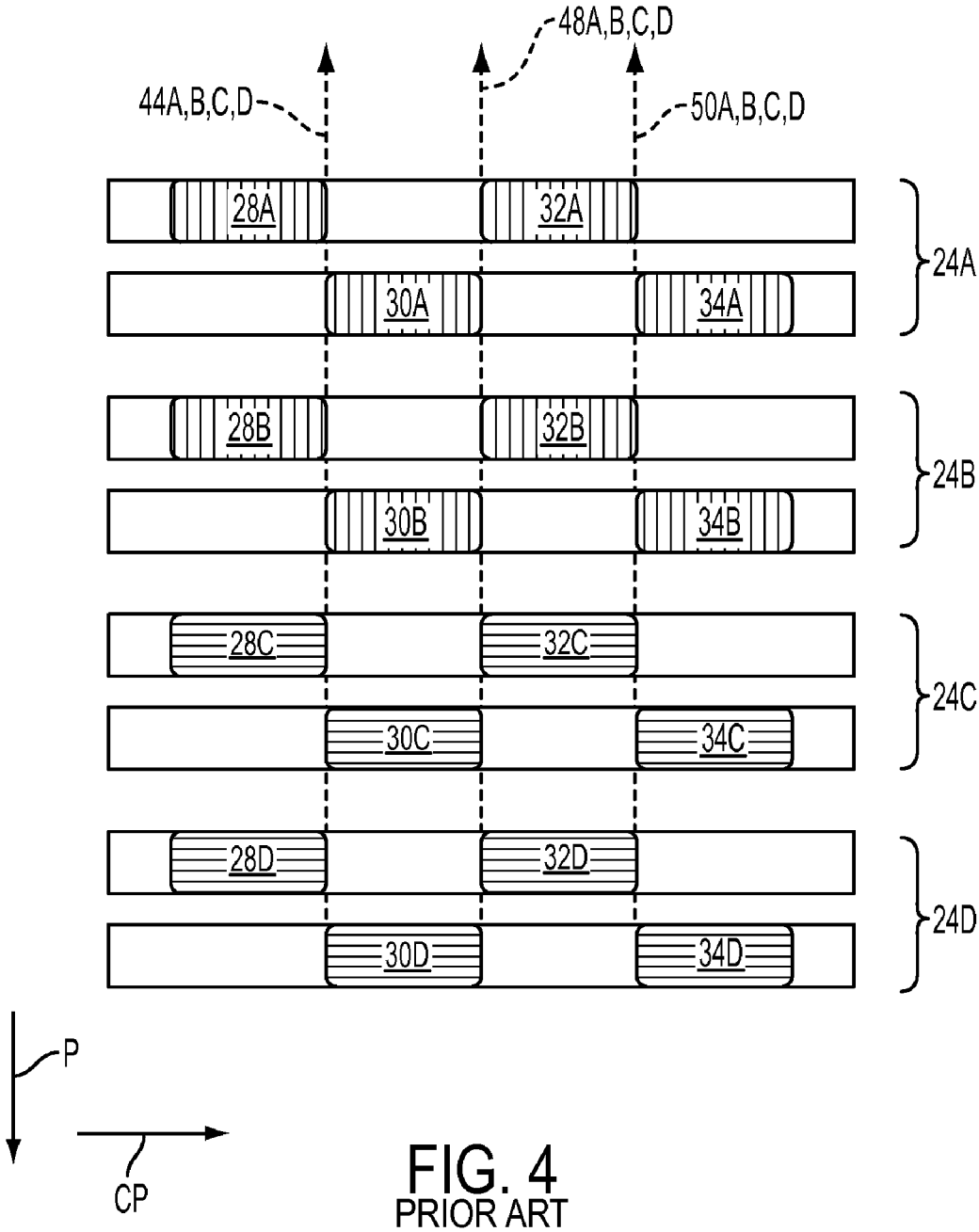
FIG. 4 PRIOR ART
FIG. 4 is a prior art view of an arrangement of printhead arrays showing the stitch lines of the printhead arrays aligned with each other.

Differences in printing characteristics of the printheads on either side of a stitch line, such as drop mass, position or some other attribute, may result in visible stitch line defects between printheads. Stitch line defects show as either a specific line defect at the stitch joint between printheads or as a density shift between printheads. In either case, stitch line defects may result in an image quality defect known as banding that extends in the process direction on a printed media. Methods have been developed for compensating or masking stitch line defects between printheads of a printhead array. In previously known printhead systems that utilized multiple printhead arrays to form images on an image receiving surface, the stitch lines of the multiple printheads were aligned. For example, FIG. 4 depicts a portion of a previously known printhead array arrangement that includes four printhead arrays 24A-D with two printhead arrays 24A and 24B for depositing a first color onto the image receiving surface and two printhead arrays 24C and 24D for depositing a second color onto the image receiving surface. As seen in FIG. 4, the stitch lines 44A-D, 48A-D, 50A-D for each printhead array 24A-D in this previously known arrangement are aligned, e.g., the stitch lines 44A-D, 48A-D, 50A-D for each printhead array 24A-D are at the same cross-process direction CP position. Aligning the stitch lines of multiple printhead arrays in this manner may result in stitch line defects from different printhead arrays to be positioned on top of each other and become even more visible.

As an alternative to aligning the stitch lines of the printhead arrays as depicted in FIG. 4, a method of arranging printhead arrays has been developed that involves offsetting or shifting the stitch lines of each printhead array along an axis parallel to the cross-process direction so that the stitch lines of each printhead array are at different locations in the cross-process direction than the stitch lines of at least one, and advantageously most or all of the other printhead arrays, in the imaging device. Offsetting or shifting the stitch lines from each printhead array in the cross-process direction form the stitch lines of the other printhead arrays causes images formed by the different printhead arrays to overlap at the stitch lines which spreads out any stitch line defects that may be generated by the printhead arrays and makes them less objectionable or visible in the resulting prints. One or more printhead arrays in a multiple printhead array system may be offset or shifted from the stitch lines of one or more other printhead arrays by a predetermined stitch offset value. As used herein, a stitch offset for a printhead array refers to a distance in the cross-process direction that the stitch lines of the printhead array are offset or shifted relative to the stitch lines of at least one other printhead array. The cross-process direction position of the stitch lines of one or more of the printhead arrays may be considered as a reference positions from which the stitch lines of the other printhead arrays are shifted or offset.

In one embodiment, stitch lines may be offset or shifted in the cross-process direction from printhead array to printhead array for printhead arrays of the same color because such printhead arrays are likely to be utilized together to form images on the image receiving surface. Similarly, stitch lines may be offset or shifted in the cross-process direction from printhead array to printhead array only for printhead arrays of different colors. Stitch offsets may be any suitable distance in the cross-process direction, and may be the same or different for each printhead array (that is desired to be offset) in the multiple printhead arrays of an imaging device. In one embodiment, stitch offsets between printhead arrays of the same color are at least 1 mm, and in one particular embodiment, at least 4 mm, and stitch offsets between printhead arrays of different colors or shades may be at least 1 mm. Accordingly, in one embodiment, all arrays of all colors are shifted in a manner so that no stitch line from any array is within 1 mm of any other stitch line.

Figure 3:
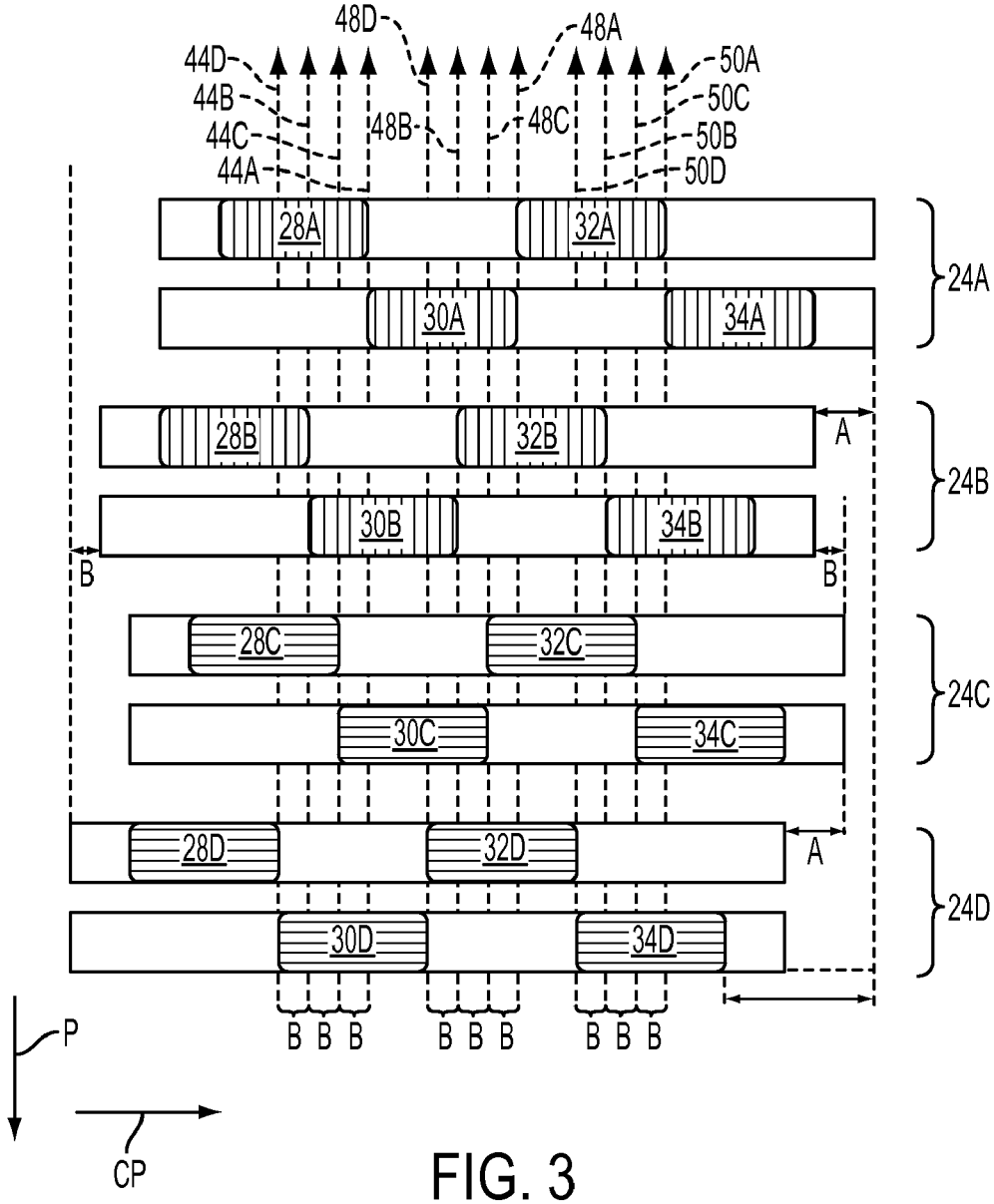
FIG. 3 is an embodiment of an arrangement of the printhead arrays of the imaging device of FIG. 1 in which the stitch lines of the printhead arrays are offset from each other.

FIG. 3 shows an embodiment of a printhead arrangement in which the stitch lines of each printhead array are offset from each other in the cross-process direction for both printhead arrays of the same color as well as for printhead arrays of different colors. In FIG. 3, printhead arrays 24A and 24B are for depositing a first color onto the image receiving surface and printhead arrays 24C and 24D are for depositing a second color onto the image receiving surface. As seen in FIG. 3, the stitch lines 44A-D, 48A-D, and 50A-D of each printhead array 24A-D are offset in the cross-process direction from each of the other stitch lines of the other printhead arrays. In one embodiment, the stitch lines 44A-D, 48A-D, and 50A-D of each printhead array 24A-D are offset from the stitch lines of other printhead arrays by a stitch offset B which, as explained above, may be at least 1 mm although any suitable offset value may be used. In the embodiment of FIG. 3, printhead arrays 24A and 24B of the first color are offset or shifted in the cross-process direction CP by a stitch offset A. Similarly, printhead arrays 24C and 24D of the second color are offset or shifted in the cross-process direction CP by the stitch offset A.

Stitch offset A for offsetting the printhead arrays of the same color is greater than the stitch offset B which is the distance that printhead arrays of different colors are offset from each other. For example, printhead array 24B is offset from both printhead array 24C and printhead array 24D by the stitch offset B. Such an arrangement enables the stitch lines from different color printhead arrays to alternate in the cross-process direction thereby limiting the offset width of the printhead system. For example, as seen in FIG. 3, the printhead arrays 24A-D are arranged such that the stitch lines 44D, 48D, and 50D of printhead array 24D are the farthest left relative to the direction CP, followed by the stitch lines 44B, 48B, and 50B of printhead array 24B, then stitch lines 44C, 48C, and 50C of printhead array 24C, and then stitch lines 44A, 48A, and 50A of printhead array 24A. A number of other similar offset arrangements may be utilized and are contemplated within the scope of this disclosure. The stitch offsets B depicted in FIG. 3 may each be the same distance although not necessarily. For example, each stitch offset B depicted in FIG. 3 may each correspond to a different offset distance between printheads. Similarly, each stitch offset A may be the same or different distances.

In one embodiment, the printhead arrays are mounted in fixed or stationary positions relative to the image receiving surface so that the stitch lines of the printhead arrays are offset from each other in the manner described above. Alternatively, however, the printhead arrays may be capable of translating along an axis parallel to the cross-process direction so that the printhead arrays may be moved or translated to positions that enable the stitch lines of the printhead arrays to be offset from each other prior to depositing marking material onto the image receiving surface to form images.

Given that the printhead arrays have been shifted, portions of width of the printhead system may be incapable of printing full density images (because only some of the heads will overlap into these zones). The present disclosure proposes that these zones may be used for certain process controls and/or timing patches thus expanding the imaging zone if one had to print those controls and patches within the full imaging areas.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An imaging device including:

an image receiving surface configured to move in a process direction in an imaging device; and a plurality of printhead arrays arranged to deposit marking material onto the image receiving surface, each printhead array in the plurality being located at a different position in the process direction, each printhead array including a plurality of printheads arrayed in a cross-process direction across the image receiving surface, each printhead array including at least one stitch line corresponding to a position along an axis parallel to the cross-process direction where an end of one printhead in the printhead array is substantially aligned with an end of another printhead in the printhead array;

the at least one stitch line of each printhead array being offset a predetermined distance in the cross-process direction from the at least one stitch line of each of the other printhead arrays.

2. The imaging device of claim 1, the plurality of printhead arrays including at least two printhead arrays for depositing a first color of marking material onto the image receiving surface, and at least two printhead arrays for depositing a second color of marking material onto the image receiving surface;

the at least one stitch line of each printhead array in the at least two printhead arrays for depositing the first color being offset in the cross-process direction from the at least one stitch line of every other printhead array in the at least two printhead arrays for depositing the first color by a first predetermined distance and offset in the cross-process direction from the at least one stitch line of each printhead array in the at least two printhead arrays for depositing the second color by a second predetermined distance different than the first predetermined distance.

3. The imaging device of claim 2, wherein the printheads of each printhead array are interlaced at the stitch lines.

4. The imaging device of claim 2, the first predetermined distance and the second predetermined distance each being at least 1 mm.

5. The imaging device of claim 4, the first predetermined distance being at least 4 mm.

6. The imaging device of claim 1, the image receiving surface comprising a substantially continuous media web.

7. The imaging device of claim 1, the image receiving surface comprising an intermediate transfer surface.

8. The imaging device of claim 1, each printhead array comprising a staggered full width array printhead having at least three printheads.

9. The imaging device of claim 8, wherein the imaging device is configured to implement a multi-pass printing process.

10. A method of arranging printhead arrays in an imaging device, the method comprising:

arranging a first printhead array adjacent an image receiving surface at a first location in a process direction of the image receiving surface, the first printhead array including at least one first stitch line corresponding to locations in the first printhead array where an end of one printhead in the first printhead array is aligned with an end of a next printhead in the first printhead array, the at least one first stitch line being located at a first position in the cross-process direction; and arranging a second printhead array adjacent the image receiving surface at a second location in the process direction of the image receiving surface, the second printhead array including at least one second stitch line corresponding to locations in the second printhead array where an end of one printhead in the second printhead array is aligned with an end of a next printhead in the second printhead array, the at least one second stitch line being located at a second position in the cross-process direction, the second position being different than the first position.

11. The method of claim 10, further comprising:

arranging a third printhead array adjacent the image receiving surface at a third location in the process direction of the image receiving surface, the third printhead array including at least one third stitch line corresponding to locations in the third printhead array where an end of one printhead in the third printhead array is aligned with an end of a next printhead in the third printhead array, the at least one third stitch line being located at a third position in the cross-process direction, the third position being different than the first and the second positions.

12. The method of claim 11, the arrangement of the first, second, and third printhead arrays further comprising:

arranging the first, second, and third printhead arrays such that the first position, second position, and third position have a predetermined distance between them in the cross-process direction.

13. The method of claim 12, the arrangement of the first, second, and third printhead arrays being performed prior to printing.

14. The method of claim 12, the predetermined distance being at least 1 mm.

15. The method of claim 11, the first printhead array and the second printhead array being configured to deposit marking material of a first color onto the image receiving surface, and the third printhead array being configured to deposit marking material of a second color onto the image receiving surface; and the arrangement of the first, second, and third printhead arrays further comprising:

arranging the first, second, and third printhead arrays such that the second position is offset from the first position by a first predetermined distance, and the third position is offset from the first position by a second predetermined distance that is less than the first predetermined distance.

16. The method of claim 15, the image receiving surface comprising a substantially continuous media web.

17. The method of claim 15, the image receiving surface comprising an intermediate transfer surface.

18. The method of claim 15, each of the first, second, and third printhead arrays comprising a staggered full width array printhead having three or more printheads.

19. A printhead system for use in an imaging device, the printhead system comprising:

a plurality of printhead arrays arranged sequentially in a process direction, each printhead array being configured to emit marking material and including a plurality of printheads arrayed in a cross-process direction, each printhead array including at least one stitch line corresponding to a position along an axis parallel to the cross-process direction where an end of one printhead in the printhead array aligns with an end of another printhead in the printhead array;

the at least one stitch line of each printhead array being offset a predetermined distance in the cross-process direction from the at least one stitch line of each of the other printhead arrays.

20. The system of claim 19, the predetermined distance being at least 1 mm.

* * * * *